US007015783B2

(12) United States Patent
Nakata et al.

(10) Patent No.: US 7,015,783 B2
(45) Date of Patent: Mar. 21, 2006

(54) COIL COMPONENT AND METHOD OF MANUFACTURING THE SAME

(75) Inventors: Toshiyuki Nakata, Mie (JP); Tsunetsugu Imanishi, Hyogo (JP); Hiroyuki Hamamoto, Hyogo (JP); Hidetoshi Hiwatashi, Osaka (JP); Tomokazu Kitagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 197 days.

(21) Appl. No.: 10/451,777

(22) PCT Filed: Feb. 26, 2002

(86) PCT No.: PCT/JP02/01736

§ 371 (c)(1),
(2), (4) Date: Jun. 26, 2003

(87) PCT Pub. No.: WO02/069360

PCT Pub. Date: Sep. 6, 2002

(65) Prior Publication Data

US 2004/0046626 A1 Mar. 11, 2004

(30) Foreign Application Priority Data

Feb. 27, 2001 (JP) ..... 2001-051803
Jan. 22, 2002 (JP) ..... 2002-012515
Jan. 24, 2002 (JP) ..... 2002-015051

(51) Int. Cl.
*H01F 27/02* (2006.01)

(52) U.S. Cl. ..... 336/83; 336/200; 336/233; 29/602.1

(58) Field of Classification Search ..... 336/83, 336/61, 212, 223, 232, 233, 234, 90, 92, 336/96, 200; 29/602.1, 606
See application file for complete search history.

(56) References Cited

U.S. PATENT DOCUMENTS 4,081,776 A * 3/1978 Hisamoto et al. ..... 336/61
4,943,793 A * 7/1990 Ngo et al. ..... 336/83
5,216,402 A * 6/1993 Carosa ..... 336/66
5,359,313 A * 10/1994 Watanabe et al. ..... 336/178

(Continued)

FOREIGN PATENT DOCUMENTS

DE 199 01 255 7/2000

OTHER PUBLICATIONS

Patent Abstracts of Japan, vol. 014, No. 234 (E-0929), May 17, 1990 & JP 02 062011 A (Matsushita Electric Ind. Co., Ltd.), Mar. 1, 1990—Abstract.

*Primary Examiner*—Anh Mai
(74) *Attorney, Agent, or Firm*—Wenderoth, Lind & Ponack, L.L.P.

(57) ABSTRACT

A coil component includes a coil 2 having a through-hole 1, a magnetic core encapsulating the coil, and a terminal 4. The magnetic core includes a top portion 11 disposed at an upper part of the coil, a bottom portion 12 disposed at a lower part of the coil, and a middle portion 13. An outer layer thickness of the middle portion (W1) is less than a diameter of the through-hole, while the top portion and the bottom portion are higher in density than the middle portion. The configuration of the present invention provides a small size coil component with less occurrence of magnetic saturation to prevent lowering of inductance even with thin top 11 and bottom portions 11, 12. The coil component further has improved reliability.

15 Claims, 6 Drawing Sheets

U.S. PATENT DOCUMENTS 6,226,148 B1 * 5/2001 Egawa et al. ..... 360/125
6,375,884 B1 * 4/2002 Shikama et al. ..... 264/254
6,650,218 B1 * 11/2003 Fushimi ..... 336/178
6,661,328 B1 * 12/2003 Inoue et al. ..... 336/233

* cited by examiner

COIL COMPONENT AND METHOD OF MANUFACTURING THE SAME

TECHNICAL FIELD

The present invention relates to a coil component used in various electronic apparatuses, and a method of manufacturing the same.

BACKGROUND ART

A conventional coil component will be described in the following with reference to the drawings.

FIG. 9 is a perspective view of a conventional coil component. FIG. 10 is a sectional view of the coil component. FIG. 11 is a sectional view of the coil component showing a part of the manufacturing process of the coil component.

In FIGS. 9–11, the conventional coil component comprises a coil 52 having a through-hole 51, packaging 53 made up of magnetic material with the coil 52 disposed therein, and a terminal 54 connected to the coil 52. The packaging 53 is formed by molding magnetic powder 55 under pressure so as to cover the coil 52.

The packaging 53 is formed under a constant molding pressure over the entire part thereof, and also the packaging 53 is nearly uniform in density over the entire part thereof.

In the configuration of such conventional coil component, when intended to lower a height of the coil component, it is necessary to increase the molding pressure applied to the packaging 53 in order to entirely compress the packaging 53.

However, although the height of the packaging 53 can be lowered by compressing the packaging 53, the top and bottom portions of the packaging 53 are also reduced in thickness. Accordingly, there has been a problem that magnetic saturation is liable to occur, worsening the reliability, when the magnetic flux passing in the through-hole of the coil 52 passes through the top and bottom portions of the packaging 53.

In order to address the above problem, the present invention provides a coil component improved in reliability, in which magnetic saturation hardly occurs even when the top and bottom portions of the coil component are reduced in thickness for the purpose of lowering the height of the coil component.

DISCLOSURE OF THE INVENTION

Packaging of the coil component of the present invention is a compressed powder magnetic core containing magnetic powder, comprising a top portion disposed at an upper part of the coil, a bottom portion disposed at a lower part of the coil, and a middle portion corresponding to the height of the coil. Also, the outer layer thickness (distance between the coil and the packaging surface) of the middle portion of the packaging including the coil is less than a diameter of the through-hole of the coil, and at the same time, a density of the top portion and the bottom portion are higher than that of the middle portion.

By the above configuration, it is possible to eliminate the occurrence of magnetic saturation at the top portion and the bottom portion even when the top and bottom portions of the packaging are lowered in height by compressing until the outer layer thickness of the middle portion including the coil becomes less than the diameter of the through-hole of the coil. This is because the density of the top portion and the bottom portion are higher than that of the middle portion.

That is, a density of the inside of the through-hole of the coil, which corresponds to the middle portion of the packaging, is lower than densities of the top and bottom portions of the packaging. Accordingly, even when the magnetic flux passing through the through-hole passes through the top and bottom portions whose thicknesses are less than the diameter of the through-hole, magnetic saturation does not occur at the top and bottom portions, enabling the lowering of the height of the coil component. This is because the magnetic permeability can be increased in the top and bottom portions where the packaging density is higher than the middle portion.

DETAILED DESCRIPTION OF THE INVENTION

First Embodiment

The present invention will be described in the following embodiment with reference to the drawings.

Figure 1:
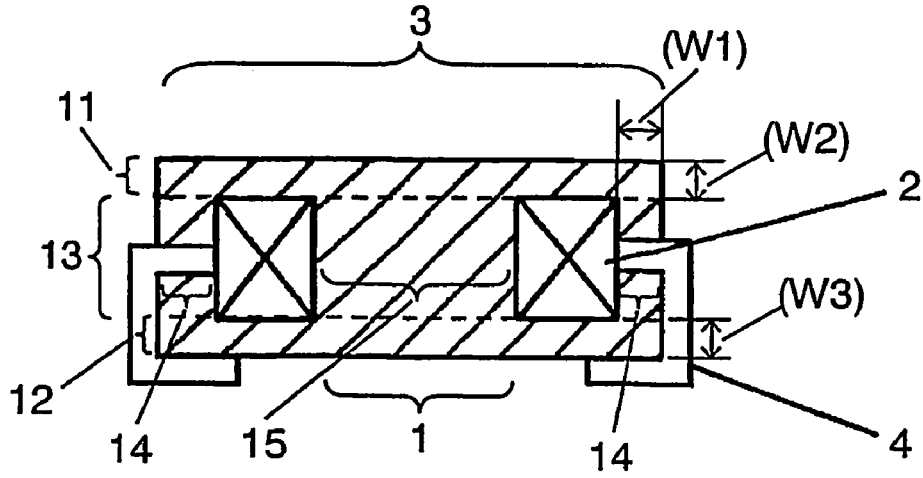
FIG. 1 is a sectional view of a coil component in one preferred embodiment of the present invention.
Figure 2:
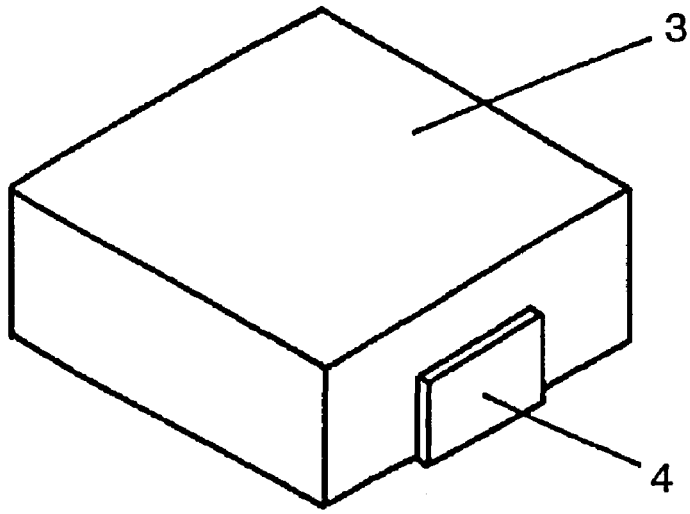
FIG. 2 is a perspective view of the coil component.
Figure 3A:
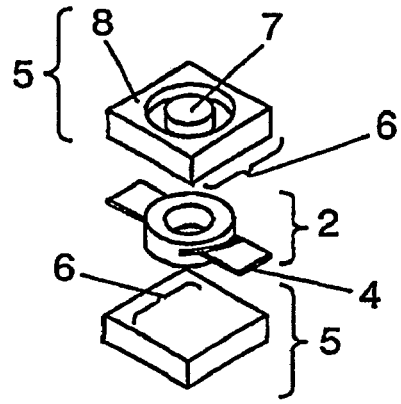
FIGS. 3(*a*) to 3(*e*) respectively show a part of the manufacturing process for the coil component.
Figure 3B:
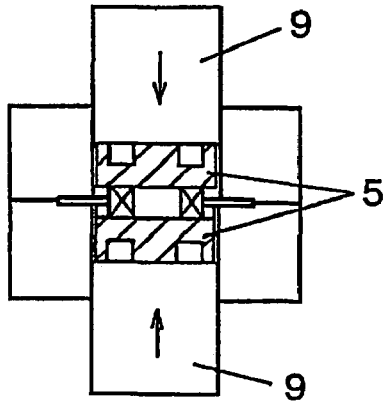
Figure 3C:
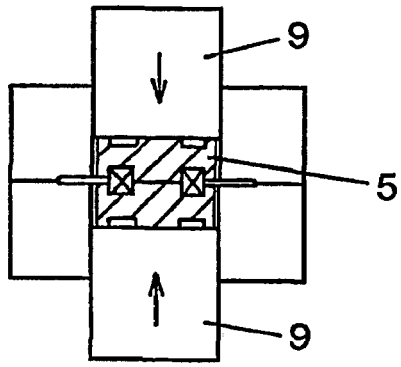
Figure 3D:
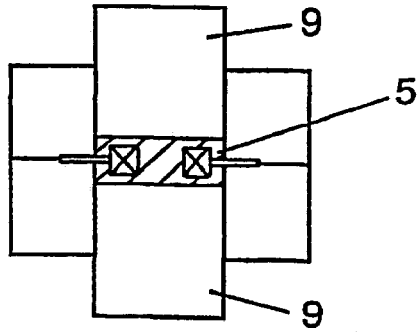
Figure 3E:
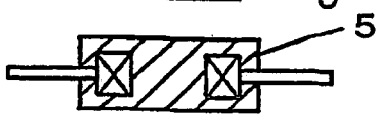
Figure 4:
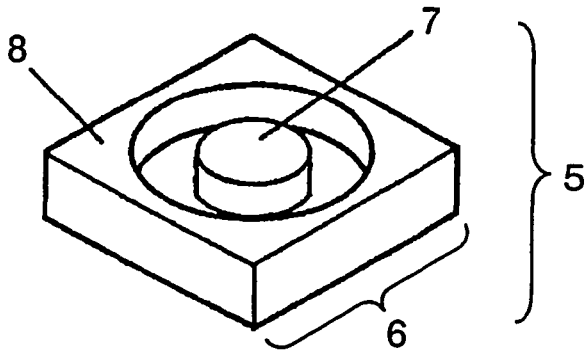
FIG. 4 is a perspective view of compressed powder for production of the coil component.
Figure 5:
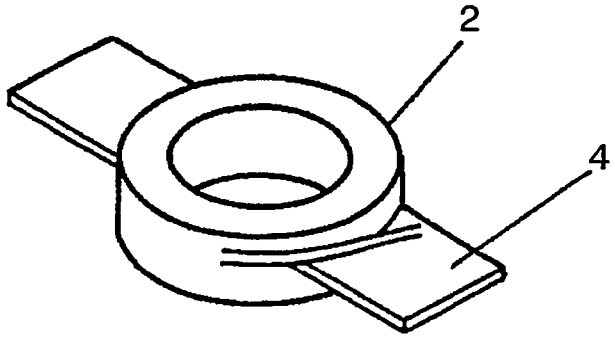
FIG. 5 is a perspective view of a coil with terminals connected thereto.
Figure 6:
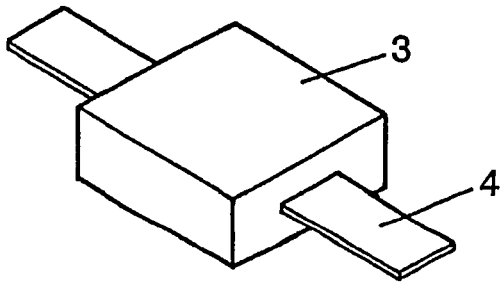
FIG. 6 is a perspective view of the coil component before terminals are formed.
Figure 7A:
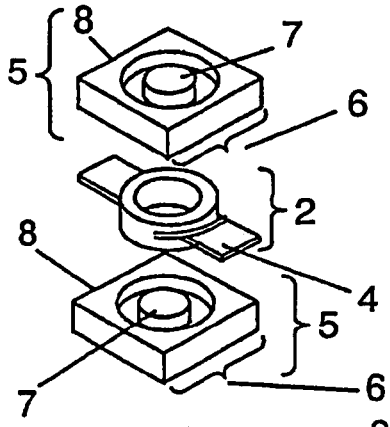
FIGS. 7(*a*) to 7(*e*) respectively show a part of a manufacturing process of another coil component of the present invention.
Figure 7B:
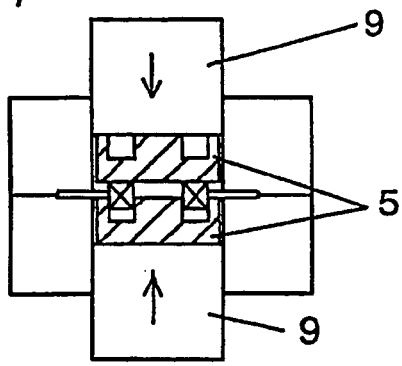
Figure 7C:
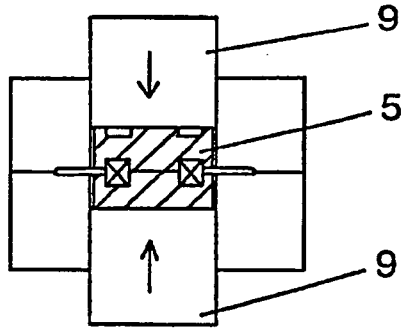
Figure 7D:
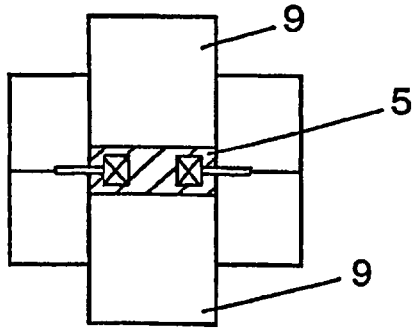
Figure 7E:
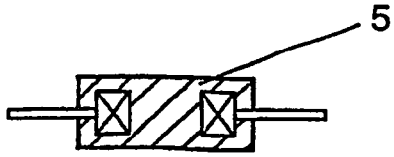
Figure 8A:
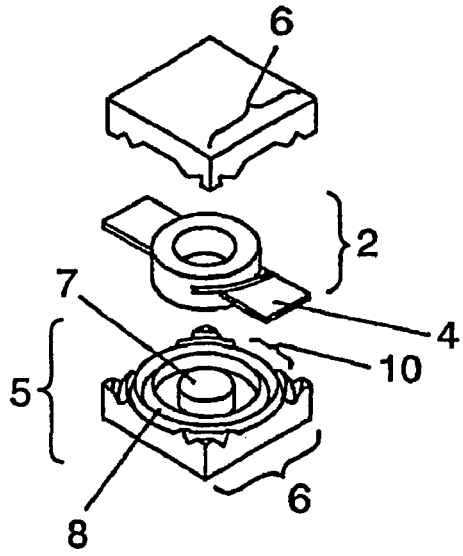
FIGS. 8(*a*) to 8(*d*) respectively show a part of a manufacturing process of yet another coil component of the present invention.
Figure 8B:
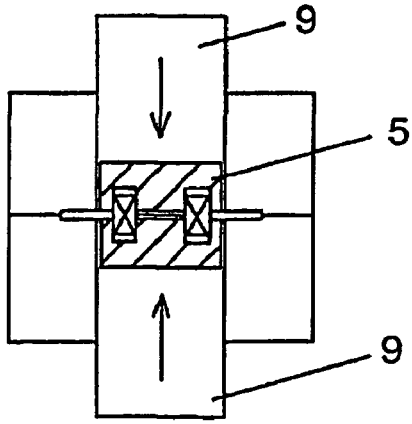
Figure 8C:
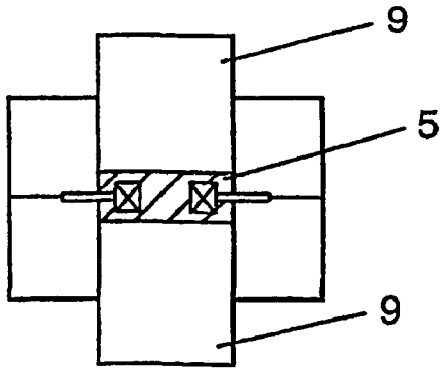
Figure 8D:
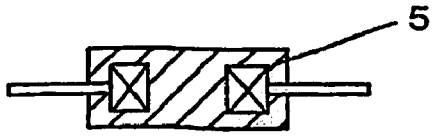
Figure 9:
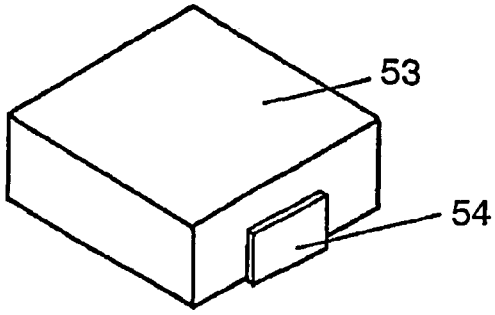
FIG. 9 is a perspective view of a conventional coil component.
Figure 10:
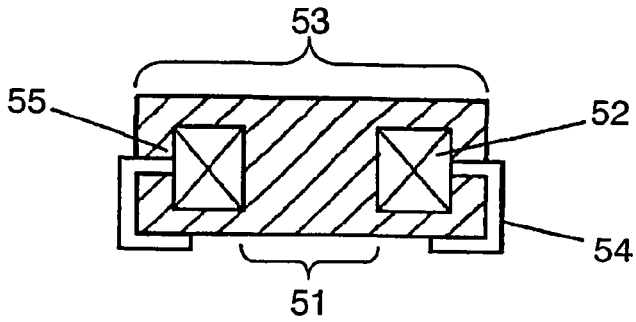
FIG. 10 is a sectional view of the conventional coil component.
Figure 11:
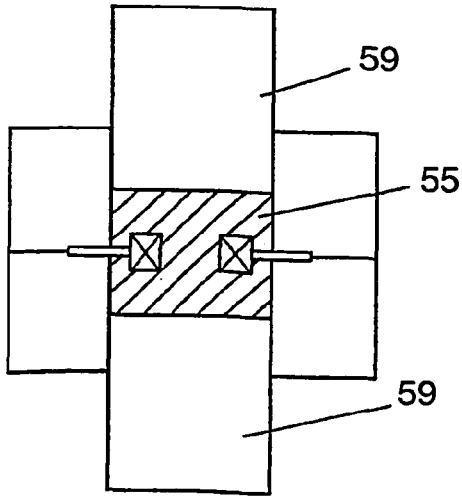
FIG. 11 is a sectional view showing a part of the manufacturing process of the conventional coil component.

FIG. 1 is a sectional view of a coil component in one preferred embodiment of the present invention. FIG. 2 is a perspective view of the coil component. FIGS. 3(*a*) to 3(*e*) shows a part of the manufacturing process of the coil component. FIG. 4 is a perspective view of compressed powder for the coil component production. FIG. 5 is a perspective view of a coil with terminals connected thereto. FIG. 6 is a perspective view of the coil component before the terminals are formed.

In FIG. 1 through FIG. 6, a coil component in an embodiment of the present invention is 2 to 5 mm high and 10 mm square in shape, comprising a coil 2 having a through-hole 1, packaging 3 encapsulating the coil 2, and terminals 4 connected to the coil 2.

Also, the packaging 3 is a compressed powder magnetic core (dust core) containing magnetic powder. The materials for the packaging 3 comprise thermosetting binder resin comprising silicone resin of tough resin component and elastic resin component and magnetic powder. The materials are mixed without heating so that the thermosetting resin does not cure and is molded under a pressure ranging from 0.5 to 2.0 t/cm$^2$, thereby forming compressed powder body 5. Further, the compressed powder body 5 is subjected to re-molding under a pressure ranging from 3.0 to 5.0 t/cm$^2$ so as to encapsulate the coil 2 while being heated at 100° C. to 180° C. so that the thermosetting resin completely cures, thereby molding packaging 3.

The compressed powder magnetic core (dust core) employs heat-treated soft magnetic alloy powder as magnetic powder. The magnetic alloy powder ranges from 1 $\mu$m to 100 $\mu$m in average particle diameter, and it includes component A, chrome (Cr), oxygen (O), manganese (Mn), carbon (C) and iron (Fe). Component A includes at least one selected from the group consisting of silicon (Si), aluminum (Al), titanium (Ti) and magnesium (Mg). The composition of each component is as follows: 1 wt %≦component A≦7 wt %, 2 wt %≦Cr≦8 wt %, 0.05 wt %≦O≦0.6 wt %, 0.01 wt %≦Mn≦0.2 wt %, 0.005 wt %≦C≦0.2 wt %, and the rest is iron (Fe). Depending on the conditions where the coil components are used, it is possible to use nickel (Ni) of 2 wt %≦Ni≦15 wt % in place of component A.

Two compressed powder bodies 5 are used for molding the packaging 3 as shown in FIG. 3(*b*). The compressed powder body 5 is provided with a strong portion where the shape of compressed powder body 5 is not collapsed by the pressure applied during a re-molding operation and a weak portion where the shape of compressed powder body 5 is collapsed due to the pressure applied during re-molding operation.

As shown in FIG. 4, the compressed powder body 5 is in a pot shape with an E-shaped cross section with back portion 6, a central portion 7 and an outside portion 8, and the back portion 6 serves as a strong portion, while the central portion 7 and the outside portion 8 respectively serve as a weak portion. The weak portion and the strong portion are formed by controlling the density of the compressed powder. That is, the density of compressed powder is lower at the weak portion, and higher at the strong portion. The strength of the weak portion is such that the shape is collapsed when a pressure of a few kg/cm$^2$ is applied.

Here, the expression that the shape of compressed powder body 5 is "collapsed" means that the shape is collapsed to a size of particle size of the magnetic powder. The strong portion has a strength high enough to keep the shape of compressed powder body 5. A state of being broken into blocks (lumps) is not included in the range of being weak since the shape is not broken into the particle size of the magnetic powder.

And as shown in FIG. 3(*a*) to FIG. 3(*d*), in molding the packaging 3, the compressed powder is re-molded under pressure so that the top and bottom of coil 2 are held by the strong portions of two compressed powder bodies 5 and that the outer periphery of coil 2 and the inner part of through-hole 1 are covered due to the collapse of the weak portion. Also, the compressed powder is heated during the re-molding under pressure so that the thermosetting resin completely cures.

In that case, the packaging 3 is molded so that an outer layer thickness (W1) shown in FIG. 1 of the middle portion enclosing the coil 2 is less than a diameter of the through-hole 1 of the coil 2. Also, as for the top portion 11 at the upper part of coil 2 (i.e. above coil 2), the bottom portion 12 at the lower part of coil 2 (i.e. below coil 2) and the middle portion 13 at the height part of coil 2 (i.e. within the height of coil 2), the top portion 11 and the bottom portion 12 are higher in density than the middle portion 13.

Particularly, the middle portion 13 is formed so that a density of the outside middle portion 14 is higher than a density of the inside middle portion 15.

As for these densities, the densities of the top portion 11 and bottom portion 12 are in a range from 5.0 to 6.0 g/cm$^3$ and that of the inside middle portion 13 is 85% to 98% of the densities of the top portion 11 and bottom portion 12.

The manufacturing method of the present invention will be described in the following.

The manufacturing method of the present invention comprises a packaging molding process for encapsulating coil 2 in packaging 3 made up of magnetic material, and a terminal forming process for forming terminals 4 connected to the coil 2.

First, the packaging molding process comprises a step of molding two compressed powder bodies 5 where a thermosetting resin binder, which includes silicone resin having tough resin component and elastic resin component, and magnetic powder are mixed without heating so that the thermosetting resin does not cure, and are molded under pressure.

Compressed powder body 5 has a pot shape with an E-shaped cross section with back portion 6, a central portion 7 and an outside portion 8, and the back portion 6 is a strong portion that is able to keep the shape of compressed powder body 5 during re-molding under pressure, while the central portion and the outside portion respectively serve as a weak portion that is unable to keep the shape of compressed powder body 5 during re-molding under pressure.

Next, the coil 2 is placed in the mold so that the top and bottom thereof are held by the strong portions of two compressed powder bodies 5, then the two compressed powder bodies 5 are re-molded under heat and pressure for molding the packaging 3. In this molding process, the outer periphery of coil 2 and the inside of through-hole 1 are covered with the weak portion.

In the re-molding, as shown in FIG. 3 (*b*), while the back portions 6 of two compressed powder bodies 5 are holding the coil 2, two punches 9 press the central portion 7 and outside portion 8, which are the weak portions of compressed powder bodies 5, thereby collapsing the weak portions of compressed powder bodies 5 and covering the outer periphery of coil 2 and the inside of through-hole 1.

Particularly, due to the pressure applied during the re-molding operation, the back portion 6 (strong portion) of each compressed powder body 5 that opposes the inner part of through-hole 1 of coil 2 is buried into the through-hole 1 of coil 2 in a block. Also, while the back portion 6 (strong portion) of each compressed powder body 5 that opposes each terminal 4 is buried toward the terminal 4 in a block, the central portion 7 (weak portion) and outside portion 8 (weak portion) of compressed powder body 5 are collapsed, thereby covering the remaining outer periphery of coil 2 and the inner part of through-hole 1.

With the mold appropriately designed, in the packaging molding process, it is possible to make the outer layer thickness (W1) of the middle portion including the coil 2 less than the diameter of through-hole 1 of the coil 2. Also, according to the manufacturing method of the present invention, top portion 11 at the upper part of coil 2 and bottom portion 12 at the lower part of coil 2 are formed higher in density than the middle portion 13 corresponding to the height part of coil 2.

Further, as for the middle portion 13, there are provided inside middle portion 15 corresponding to the through-hole 1 of coil 2 and outside middle portion 14 corresponding to the outer periphery of coil 2, and the outside middle portion 14 is formed higher in density than the inside middle portion 15.

And the packaging 3 is molded so that the densities of the top portion 11 and bottom portion 12 is in a range from 5.0 to 6.0 g/cm$^3$, while that of the inner middle portion 13 is 85% to 98% of the densities.

By the above configuration and method, even when the height of a coil component is lowered as a whole by making the outer layer thickness (W1) of the middle portion including the coil 2 less than the diameter of through-hole 1 and by forming the top portion 11 and bottom portion 12, reducing the thickness thereof, it is possible to form the top portion 11 and the bottom portion 12 higher in density than the middle portion 13. As a result, it is possible to suppress the occurrence of magnetic saturation at the top portion 11 and the bottom portion 12.

That is, the top portion 11 and bottom portion 12 of the packaging 3 are higher in density than the inner part 15 of middle portion 13, which corresponds to the inside of through-hole 1. Accordingly, even when the magnetic flux passing through the through-hole 1 passes through the top portion 11 and the bottom portion 12 whose thickness (W2, W3) is less than the diameter of through-hole 1, the top portion 11 and the bottom portion 12 can obtain higher magnetic permeability since the top portion 11 and the bottom portion 12 are higher in density than the middle portion 13. As a result, the height of the coil component can be lowered without allowing the occurrence of magnetic saturation at the top portion 11 and the bottom portion 12.

Also, the middle portion 13 includes inside middle portion 15 corresponding to through-hole 1 and outside middle portion 14 corresponding to the outside portion of coil 2. Since the outside middle portion 14 is higher in density than the inside middle portion 15, outside middle portion 14 can obtain higher magnetic permeability. Accordingly, it is possible to reduce the size of the coil component in the lateral direction thereof and to save the space for mounting of the coil component without allowing the occurrence of magnetic saturation at the outside middle portion 14.

Particularly, the packaging 3 is molded so that the densities of the top portion 11 and bottom portion 12 are in a range from 5.0 to 6.0 g/cm$^3$ and that of the inner middle portion 13 is 85% to 98% of the densities, and therefore, excessive stresses will not be applied to the coil 2. At the same time, it is possible to suppress the breakdown of packaging 3 itself due to internal stresses or the like while suppressing the breakdown of coil 2. Also, it is possible to suppress the occurrence of magnetic saturation and to make the coil component smaller in size.

The packaging 3 is a compressed powder magnetic core, and has a specific composition. That is, the ratio of Fe component is high and it is advantageous for DC-bias characteristics. Moreover, having the compressed powder magnetic core Cr component suppresses the generation of rust due to the presence of the Fe component. Further, since the Cr content is not more than 8 wt %, it is possible to suppress a loss in a frequency range of higher than 100 kHz. In this way, the present invention is able to realize a composite magnetic material having excellent corrosion resistance without losing the magnetic characteristic.

Also, an ordinary powder molding generally uses powder for the molding, but in the present invention where solid compressed powder body 5 is used, the quantity of compressed powder body 5 between the punch 9 and the coil 2 hardly varies during re-molding under pressure, and the covering thickness of packaging 3 is easier to make uniform over the entire periphery of coil 2. Accordingly, it is possible to suppress the dispersions in characteristics such as inductance, saturation characteristic and magnetic losses during DC-biasing of the inductance. Further, since the coil 2 can be held by compressed powder bodies 5, the coil 2 is precisely positioned, and defective molding of packaging 3 may be prevented. Regarding the compressed powder body 5, magnetic powder and binder including thermosetting resin are mixed and pressed to form compressed powder body 5. And, the thermosetting resin includes silicone resin having tough resin component and elastic resin component, and therefore it is possible to mold the packaging well balanced in strength and brittleness, and to minimize defects of packaging 3.

Further, since coil 2 is covered when compressed powder body 5 is re-molded under pressure, the coil 2 can be precisely covered. Also, as gaps between compressed powder 5 and coil 2 can be completely filled, it is possible to improve the magnetic efficiency by reducing the magnetic gaps.

Particularly, as the strong portion of compressed powder body 5 reliably holds one side of coil 2, the position of coil 2 is hardly misaligned during re-molding under pressure, and another side of coil 2 can be easily covered with the weak portion of compressed powder body 5 as the weak portion collapses. Accordingly, it is possible to make the covering of packaging 3 uniform in thickness over the entire periphery of coil 2 and to suppress the dispersions in characteristics of the coil component.

Also, the compressed powder body 5 is in a pot shape with an E-shaped cross section with back portion 6, a central portion 7 and an outside portion 8, and the back portion 6 is a strong portion, while the central portion 7 and the outside portion 8 respectively serve as a weak portion. As a result, positional misregistration (misalignment) hardly occur due to the strong portion of compressed powder body 5, and it is easier to cover the other side of coil 2, and the dispersions in characteristics of the coil component can be reduced.

As described above, according to the embodiment of the present invention, the covering of packaging 3 is more easily made uniform in thickness over the entire periphery of coil 2, and it is possible to reduce the dispersions in characteristics and also to obtain higher magnetic permeability in top portion 11 and bottom portion 12 as the top portion 11 and bottom portion 12 of packaging 3 are higher in density than the middle portion 13. Also, the height can be lowered without allowing the occurrence of magnetic saturation at the top portion 11 and the bottom portion 12.

In the embodiment of the present invention, the compressed powder 5 has an E-shaped cross section, but it is also possible to make the central portion 7 longer or shorter than the outside portion 8 provided that the shape is within the scope of the present invention. Particularly, a T-shaped cross section with only the central portion 7 formed at the back portion 6 and a C-shaped cross section with only the outside portion 8 formed at the portion can be considered equivalent to the E-shaped cross section of the present embodiment.

Also, as for the relative positions of coil 2 and compressed powder bodies 5, one side of the coil 2 may be held by a strong portion of one compressed powder body 5, while another side of the coil 2 is supported by a weak portion of another compressed powder body 5. In that case, it is also allowable to make the strong portion of E-shaped compressed powder body 5 higher in density than the weak portion.

Further, as for the coil 2, it is allowable to wind a flat wire as well as a round wire into an edgewise coil. In this case, it is possible to enhance the space factor of the coil and to make it compatible with high current. Especially, when a flat wire is tightly wound so that packaging 3 will not be molded between the adjacent flat wires, it is possible to suppress the generation of magnetic flux that circulates around the flat wire and to reduce the losses since the packaging 3 is not molded between the flat wires.

As other examples of molding, as shown in FIG. 7 and FIG. 8, one of the compressed powder body 5 can be re-molded under pressure so that one side of the coil 2 is held by the back portion 6 of the strong portion, and another compressed powder body 5 is placed so that the central portion 7 is inserted into the through-hole 1 of coil 2. Also, as shown in FIG. 8, re-molding can be performed using two compressed powder bodies 5 having small peaks and valleys 10 at tip end portions of central portion 7 or the outside portion 8 and opposed to each other. Further, it is also possible to perform re-molding, providing one or more dividing grooves at the back portion 6 of compressed powder body 5. By using various arrangements of the compressed powder bodies 5 as described above, it becomes possible to cover the coil 2 more easily and to minimize the dispersions in characteristics of the coil component.

In the present embodiment of the present invention, before or during re-molding under pressure, one side of the coil 2 is supported by the strong portion of compressed powder body 5, but it is preferable to let one side of the coil 2 be supported by the strong portion of the compressed powder body even after re-molding under pressure.

INDUSTRIAL APPLICABILITY

According to the present invention as described above, even when the height of a coil component is lowered as a whole by forming the top portion of the packaging, corresponding to the upper part of the coil, and the bottom portion of the packaging, corresponding to the lower part of the coil, less in thickness until the outer layer thickness of the middle portion including the coil becomes less than the diameter of the through-hole of the coil, it is possible to suppress the occurrence of magnetic saturation at the top and bottom portions since the top portion and the bottom portion are higher in density than the middle portion.

That is, the density of the inside of the through-hole of the coil, which corresponds to the middle portion of the packaging, is lower than the density of the top portion and bottom portion of the packaging. Accordingly, the magnetic permeability can be increased at the top portion and bottom portion as the top portion and bottom portion are higher in density than the middle portion. Thus, it is possible to provide a coil component and its manufacturing method by which the height can be lowered without allowing the occurrence of magnetic saturation at the top and bottom portions even when the magnetic flux passing through the through-hole of the coil passes through the top portion and the bottom portion whose thickness is less than the diameter of the through-hole.

The invention claimed is:

1. A coil component comprising:

a coil having a through-hole;

a magnetic core encapsulating said coil; and a terminal connected to said coil;

wherein said magnetic core includes a top portion disposed above said coil, a bottom portion disposed below said coil, and a middle portion disposed within a height of said coil;

wherein said middle portion of said magnetic core includes an inner middle portion disposed within said through-hole of said coil, and an outer middle portion disposed outside said coil;

wherein a layer thickness of said outer middle portion is less than a diameter of said through-hole; and wherein said top portion and said bottom portion of said magnetic core are higher in magnetic permeability than said middle portion of said magnetic core.

2. The coil component according to claim 1, wherein said magnetic core is formed such that densities of said top and bottom portions of said magnetic core are in a range of 5.0 to 6.0 g/cm$^3$, and a density of said inner middle portion of said magnetic core is 85% to 98% of the densities of said top and bottom portions of said magnetic core.

3. The coil component according to claim 1, wherein said coil is constituted by an edgewise coil formed of a flat wire wound such that adjacent flat wire turns are in tight contact with each other.

4. The coil component according to claim 1, wherein said magnetic core comprises magnetic powder and a binder including thermosetting resin.

5. The coil component according to claim 4, wherein said thermosetting resin is a silicone resin including a tough resin component and an elastic resin component.

6. A method of manufacturing a coil component comprising:

forming a compressed powder body having a high strength portion and a low strength portion by compression molding of a mixture comprising magnetic powder and a thermosetting resin;

preparing a coil having a through-hole;

connecting a terminal to said coil;

forming a magnetic core encapsulating said coil by carrying out a re-molding process of compression molding said compressed powder body together with said coil in a mold, and then heating said compressed powder body together with said coil;

wherein said forming of said magnetic core encapsulating said coil is carried out in such a manner as to form said magnetic core about said coil such that said magnetic core includes a top portion disposed above said coil, a bottom portion disposed below said coil, and a middle portion disposed within a height of said coil, said middle portion of said magnetic core including an outer middle portion disposed outside said coil, such that a layer thickness of said outer middle portion is less than a diameter of said through-hole, and such that said top portion and said bottom portion of said magnetic core are higher in magnetic permeability than said middle portion of said magnetic core.

7. The method according to claim 6, wherein said forming of said magnetic core encapsulating said coil is carried out such that said middle portion of said magnetic core further includes an inner middle portion disposed within said through-hole of said coil.

8. The method according to claim 6, wherein said forming of said magnetic core encapsulating said coil is carried out such that densities of said top and bottom portions of said magnetic core are in a range of 5.0 to 6.0 g/cm$^3$, and a density of said inner middle portion of said magnetic core is 85% to 98% of the densities of said top and bottom portions of said magnetic core.

9. The method according to claim 6, wherein said forming of said compressed powder body is carried out by mixing and molding said magnetic powder and said thermosetting resin without heating.

10. The method according to claim 6, wherein said forming of said compressed powder body is carried out such that said strong portion of said magnetic core has sufficient strength to enable said strong portion to retain its shape and a weak portion has insufficient strength to enable said weak portion to retain its shape, when said compressed powder body undergoes said re-molding process.

11. The method according to claim 10, wherein in said forming of said magnetic core encapsulating said coil, one side of said coil is supported by said strong portion of said compressed powder body and the other side of said coil is covered by said weak portion of said compressed powder body.

12. The method according to claim 10, wherein said compressed powder body has an E-shaped cross section including a back portion, a central portion and an outside portion; and said back portion of said compressed powder body constitutes the strong portion, and said central portion and outside portion of said compressed powder body constitute said weak portion.

13. The method according to claim 12, wherein a tip end of said central portion or said outside portion has small peaks and valleys.

14. The coil component according to claim 12, wherein at least one dividing groove is provided at said back portion of said compressed powder body.

15. The method according to claim 6, wherein said thermosetting resin is a silicone resin including a tough resin component and an elastic resin component.

* * * * *